US005997392A

United States Patent [19]

Chamberlin et al.

[11] Patent Number: 5,997,392

[45] Date of Patent: Dec. 7, 1999

[54] SLURRY INJECTION TECHNIQUE FOR CHEMICAL-MECHANICAL POLISHING

[75] Inventors: Timothy S. Chamberlin, Fairfax; Matthew K. Miller, Burlington; Erick G. Walton, So. Burlington, all of Vt.

[73] Assignee: International Business Machines Corporation, Armonk, N.Y.

[21] Appl. No.: 08/898,063

[22] Filed: Jul. 22, 1997

[51] Int. Cl.[6] ..... B24B 57/00

[52] U.S. Cl. ..... 451/446; 451/287

[58] Field of Search ..... 451/285, 289, 451/41, 60, 446, 447, 450

[56] References Cited

U.S. PATENT DOCUMENTS

| | | | |
|---|---|---|---|
| 3,028,711 | 4/1962 | Campbell et al. . | |
| 3,107,463 | 10/1963 | Davis, Jr. et al. . | |
| 3,342,652 | 9/1967 | Reisman et al. . | |
| 3,848,366 | 11/1974 | David . | |
| 4,326,553 | 4/1982 | Hall . | |
| 4,549,374 | 10/1985 | Basi et al. . | |
| 4,910,155 | 3/1990 | Cote et al. . | |
| 5,084,071 | 1/1992 | Nenadic et al. . | |
| 5,403,228 | 4/1995 | Pasch . | |
| 5,578,529 | 11/1996 | Mullins | 451/287 |
| 5,584,749 | 12/1996 | Mitsuhashi et al. | 451/285 |
| 5,651,725 | 7/1997 | Kikuta et al. | 451/286 |
| 5,679,063 | 10/1997 | Kimura et al. | 451/446 |
| 5,707,274 | 1/1998 | Kim et al. | 451/288 |
| 5,709,593 | 1/1998 | Guthrie et al. | 451/287 |
| 5,722,875 | 3/1998 | Iwashita et al. | 451/288 |
| 5,733,177 | 3/1998 | Tsuchiya et al. | 451/288 |

*Primary Examiner*—David A. Scherbel
*Assistant Examiner*—Derris Holt Banks
*Attorney, Agent, or Firm*—Delio & Peterson LLC; John J. Tomaszewski; Howard J. Walter, Jr.

[57] ABSTRACT

An apparatus for polishing a semiconductor wafer is provided comprising a wafer carrier to provide a force against a wafer and a rotating polishing pad during the polishing operation and a polishing slurry distributor device disposed to provide a spray of the slurry on the polishing pad. The wafer is polished using less slurry than a conventional polishing apparatus while still maintaining the polishing rates and polishing uniformity of the prior art polishing apparatus. A preferred spraying means is a closed elongated tube having a plurality of openings which tube is positioned over at least one-half the diameter of the polishing pad and a polishing slurry under pressure is directed onto the surface of the pad, preferably in a substantially transverse spray stream.

25 Claims, 1 Drawing Sheet

SLURRY INJECTION TECHNIQUE FOR CHEMICAL-MECHANICAL POLISHING

BACKGROUND OF THE INVENTION

1. Field of the Invention

The present invention relates to processing of semiconductor wafers and other electronic substrates such as slices of semiconductor silicon and other articles requiring a planar surface, and, more particularly, to an improved method and apparatus for polishing the wafers using the chemical-mechanical planarization process achieving high polishing rates and wafer planarity and uniformity while using smaller amounts of the chemical slurry than conventionally used in the process.

2. Problem to be Solved

In the manufacture of integrated circuits, wafer surface planarity is of extreme importance. Pholoithographic processes are typically pushed close to the limit of resolution and it is essential that the wafer surface be highly planar so that the electromoganetic or other radiation used to create the integrated circuit may be accurately focused in a single level thus resulting in precise imaging over the entire surface of the wafer. Wavy, curved or wedge-shaped semiconductor disks result in lack of definition when, for example, a photosensitive resist is applied to the surface of the disk and exposed.

In order to achieve the degree of planarity required to produce ultra high density integrated circuits, chemical-mechanical planarization processes are now typically employed in the industry. In general, the chemical-mechanical planarization (CMP) process involves pressing a semiconductor wafer or other such electronic component or other substrate against a moving polishing surface that is wetted with a chemically reactive, abrasive slurry. The slurries are usually either basic or acidic and generally contain alumina or silica particles. The polishing surface is typically a planar pad made of a relatively soft, porous (open pored) material such as blown polyurethane. The pad is usually mounted on a planar platen.

In general, the wafer is secured to a carrier plate (or wafer carrier) by vacuum or by a mounting medium such as an adhesive, with the wafer having a force load applied thereto through the carrier by a pressure plate so as to press the wafer into frictional contact with a polishing pad mounted on a rotating turntable. The carrier and pressure plate also rotate as the result of either the driving friction from the turntable or rotation drive means directly attached to the pressure plate. In a typical polishing machine, the movement of the carrier is programmed to acquire a wafer from a first station, to transport the wafer to a polishing surface, to drive the wafer across the rotating polishing surface, to transport the wafer from the polishing surface to a second station, and to release the wafer at the second station. A typical way of securing and releasing the wafer is by the use of a vacuum head that includes a rigid perforated plate against which the wafer is drawn by applying a vacuum to a plenum lying above the perforated plate.

All chemical-mechanical polishing (CMP) processes are dependent on the ability of a polishing template, or pad, to transport the polishing medium, or slurry, to the substrate surface efficiently. This transport of slurry is inhibited by the gradual accumulation of polishing by-products on the template, or pad, surface. These by-products tend to fill the natural surface porosity of the pad as the polishing process continues over time, and this causes the polishing rate to decrease and the non-uniformity of the polishing process to increase.

Polish by-products may be partly removed by "flooding" the pad surface with additional slurry, although this is an expensive response to the basic problem, and it is not completely effective. For these reasons, the polishing process is expensive to control, especially in high-volume production applications. Due to a lack of polish-rate stability, it is difficult to predict the duration of a polishing process, and the polish times tend to increase on successively polished substrates unless the polishing surface is treated by specific means. These problems decrease product throughput, which is a major cost-driver in CMP.

Surface transport issues also affect the uniformity of the polishing across the substrate surface. Further, the buildup of polish by-products on the pad surface may also increase the incidence of physical defects on the wafer surface. Both of these latter problems (uniformity and defects) also increase production costs, because they may decrease product yields, another primary driver of process costs.

A current method of chemical slurry application involves dripping slurry onto the polishing pad through a tube so as to pool the slurry in the center of the pad. This method is generally inefficient to coat the pad and excess slurry is typically applied to maintain a fluid layer between the pad and the wafer. A fluid layer is considered necessary to achieve an acceptable polishing rate and polishing uniformity.

U.S. Pat. No. 4,910,155 describes the basic CMP process and utilizes a retaining wall around the polishing pad and polishing table to retain a pool of slurry on the pad. U.S. Pat. No. 5,403,228 discloses a technique for mounting multiple polishing pads to a platen in a CMP process. A seal of material impervious to the chemical action of the polishing slurry is disposed about the perimeter of the interface between the pads and when the pads are assembled the bead squashes and forms a seal and causes the periphery of the upper pad to curve upward creating a bowl-like reservoir for increasing the residence time of slurry on the face of the pad prior to overflowing the pad. U.S. Pat. No. 3,342,652 shows a process for chemically polishing a semiconductor substrate and a slurry solution is applied to the surface of the pad in bursts as a stream forming a liquid layer between the cloth and the wafers to be polished. The solution is applied from a dispensing bottle and is applied tangentially to the wafer-plate assembly so as to provide maximum washing of the polishing cloth in order to remove waste etching products. U.S. Pat. No. 4,549,374 shows the use of a specially formulated abrasive slurry for polishing semiconductor wafers comprising montmorillonite clay in deionized water.

U.S. Pat. No. 3,107,463 is directed to a method and apparatus for simultaneously polishing both surfaces of a glass ribbon moving along a continuous path. Basically, the working faces of both surfacing tools are periodically disengaged from the working face of the glass ribbon and a fluid surfacing medium is fed onto the glass surfaces while the tools are so disengaged. U.S. Pat. No. 3,028,711 relates to a grit distributing apparatus for lapping machines wherein the liquid vehicle containing grit in suspension is applied to a rotating lap plate continuously in small quantities. U.S. Pat. No. 3,848,366 also shows a means of supplying an abrasive solution to a lapping machine. The solution is applied under pressure to a tubular member having a rod freely rotatable therein permitting the solution to flow axially along the rod and to be deposited upon the lapping plate.

All the above patents are hereby incorporated by reference.

Bearing in mind the problems and deficiencies of the prior art, it is therefore an object of the present invention to provide an apparatus, e. g., a CMP apparatus, for polishing semiconductor wafers and other workpieces using smaller amounts of the chemical or other slurry used to polish the workpiece while still maintaining the polishing rate and uniformity of the polished surface.

It is another object of the present invention to provide an improved method for polishing workpieces, e. g., semiconductor wafers, using such a polishing apparatus as the CMP system and using the improved CMP apparatus of the invention.

It is an additional object of the invention to provide a spraying device for use in polishing apparatus for polishing electronic substrates such as wafers, e.g., CMP apparatus, and for use in polishing methods such as CMP methods to enhance the efficiencies and operation of the CMP apparatus and method.

It is a further object of the invention to provide planar workpieces, including semiconductor wafers, made using the improved method and apparatus of the invention.

Other objects and advantages of the present invention will be readily apparent from the following description.

SUMMARY OF THE INVENTION

The above and other objects, which will be apparent to those skilled in the art, are achieved in the present invention which is directed in a first aspect to a method for polishing workpieces such as semiconductor wafers and other electronic component substrates using a polishing pad which comprises spraying a polishing slurry onto the surface of the pad in the form of droplets or spray. The spray is preferably essentially transverse to the plane of the polishing pad. In a preferred embodiment, the method comprises securing the wafer to the lower surface of wafer carrier means and applying a force to the upper surface of the wafer carrier to contact the wafer with a polishing pad and a polishing slurry distributed on the pad surface wherein the polishing slurry is applied to the polishing pad under pressure in the form of a spray or droplets which slurry is preferably dispersed uniformly over at least a part of the pad surface and preferably in a direction essentially transverse to the pad surface. The slurry forms a slurry film on the pad surface and preferably, the spray or droplets penetrate the openings in the pad and the slurry is uniformly applied over the pad surface. Using the method and apparatus of the invention it has been found that the polishing rate and wafer uniformity can be substantially maintained using less polishing slurry than conventional prior art slurry application techniques.

It is preferred that a pressure i.e., typically up to 100 psi, e.g., 20–50 psi, spray injection device be employed so that the slurry spray is applied uniformly over at least part of the polishing pad surface. Preferably a spray tube device is employed which comprises a closed elongated rectangular or tubular device having a plurality of openings therein. The length of the device is preferably about the diameter of the polishing pad typically about 40–80% of the diameter and is disposed over one-half of the polishing pad surface so that about one-half of the pad surface is sprayed at one time. Since the pad is rotating, the spray will contact the whole surface continually during the polishing process. The slurry is fed into the spray device and the slurry sprayed onto the polishing pad through the openings therein during the polishing operation. The slurry spray is essentially transverse to the polishing pad surface. The wafer is typically moved over the other half of the polishing pad. This is shown in the drawings.

In an additional aspect of the invention an apparatus is provided for polishing a surface of a workpiece such as a semiconductor wafer comprising:

a rotatable turntable assembly;

a polishing pad supported on said assembly;

a rotatable carrier, located above said assembly and adapted to hold a workpiece during polishing, with said workpiece secured on the lower surface of the carrier and positioned between said carrier and said polishing pad so that when a force is applied to the upper surface of the wafer carrier the wafer contacts the polishing pad and the wafer carrier provides a force across the wafer surface such that the polishing process imparts a flat polished wafer surface;

spraying means disposed over the surface of the polishing pad having a plurality of openings therein; and pressure means to feed a chemical slurry into the spraying means forcing the sLurry through the openings forming a spray which impinges on the polishing pad surface.

In another aspect of the invention wafers and other workpiece articles are provided which have been polished using the method and apparatus of the invention.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
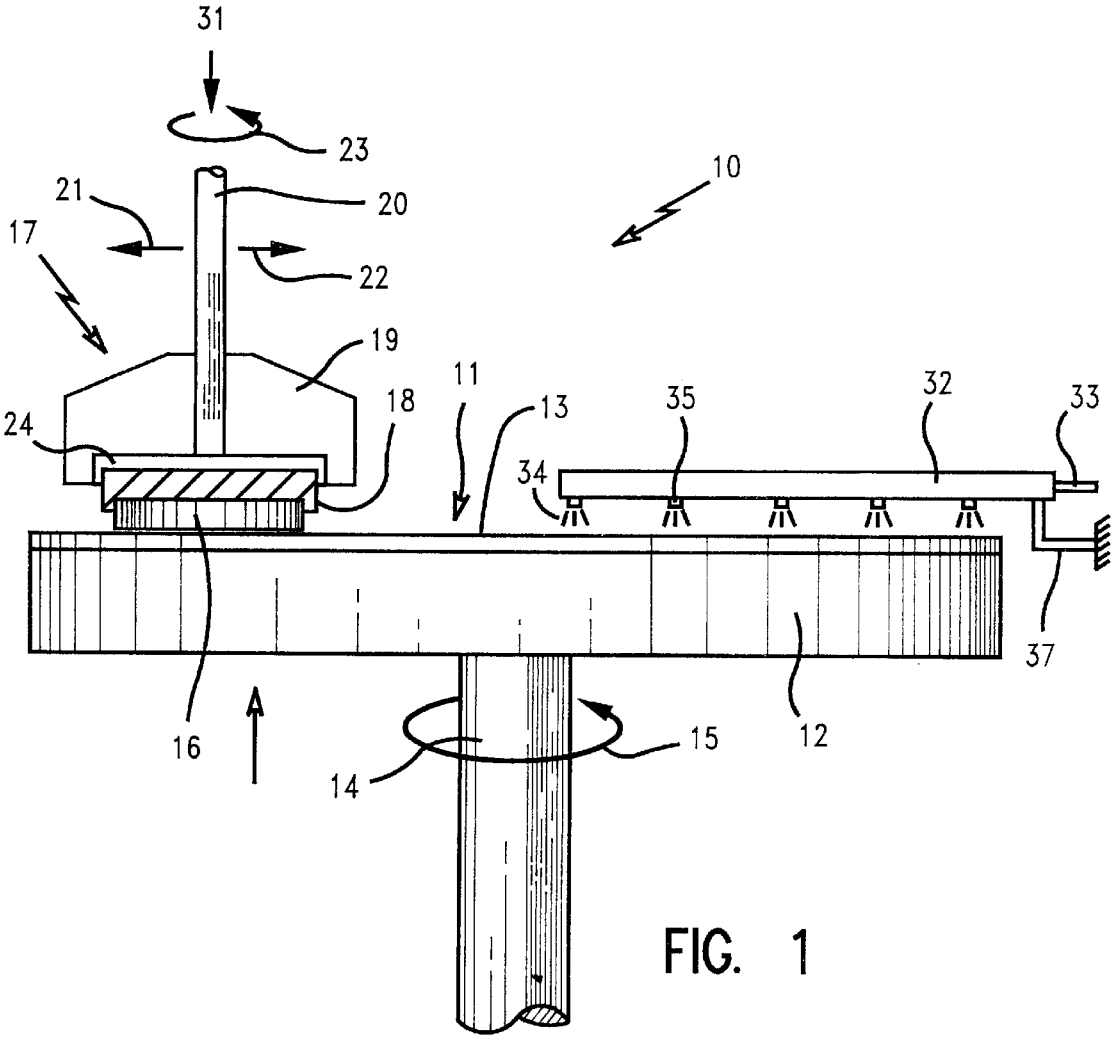
FIG. 1 is a schematic illustration of a typical CMP apparatus for polishing a semiconductor wafer utilizing the spraying means of the invention.

In describing the preferred embodiment of the present invention, reference will be made herein to FIGS. 1–2 of the drawings in which like numerals refer to like features of the invention. Features of the invention are not necessarily shown to scale in the drawings.

Referring to the drawings, FIG. 1 shows a typical CMP apparatus for polishing a semiconductor wafer which apparatus has been modified using a spraying means of the invention. The polishing apparatus shown generally as 10 includes a polishing wheel assembly shown generally as 11. The polishing wheel assembly includes a polishing table 12 to which is attached a polishing pad 13. A conventional pad is a Rodel IC1000 polyurethane pad. The polishing table 12 is rotated by shaft 14 in the direction indicated by arrow 15 by any suitable motor or driving means (not shown). The polishing pad is typically polyurethane foam having open pores and is about 22 inch in diameter and 0.050 inch thick.

A wafer carrying assembly shown generally as 17 includes a wafer carrier 18 shown holding wafer 16. A pressure plate 19 is secured to the wafer carrier 18 for applying pressure to the wafer carrier and wafer. In the embodiment shown, a hollow spindle 20 is coupled to the pressure plate and is driven by a suitable motor or driving means (not shown) for moving the wafer carrier assembly 17 in the directions shown by the arrows 21, 22 and 23. As shown by the arrow 31, pressure can be applied to the spindle 20 by a weight load and/or a pressurized fluid such as compressed air can be used to exert pressure on the upper surface of wafer carrier 18 by supplying the pressurized fluid to space 24 of the wafer carrier assembly. The force is essentially uniform over the surface of the wafer carrier and wafer. The wafer carrier assembly in a preferred embodiment moves over one-half of the pad surface 13. The spray distributor 32 is shown as stationary and fixedly connected to support arm 37. The distributor sprays the other half of the pad surface. The distributor is typically positioned about 1–3 inches above the surface of the pad but this may vary widely. It is also contemplated that the distributor 32 may be disposed over the whole polishing pad and the wafer carrier 17 be moved over the whole polishing pad. The configuration shown in FIG. 1, however, has proven effective and, as can be seen, the whole surface of the polishing pad 13 is sprayed because of the rotating motion of the polishing pad and, consequently, the wafer 16 is continually exposed to a pad 13 having slurry thereon.

During polishing, a slurry is applied by spraying means 32 to the surface of the pad 13 and is injected or forced into the open pores of the polishing pad and also forms a layer of slurry on the pad surface which flows between the wafer 16 carried by the wafer carrier assembly 17 and the polishing pad 13 of polishing wheel assembly 11. Any suitable slurry may be used. Silica based slurries such as Cabot SC112 are preferred. The spray means 32 has an inlet 33 for feeding slurry to the spray means. The slurry is forced under pressure from the spray means 32 in the form of a spray or droplets 34 from nozzles 35. Due to the chemical slurry spray and the spray pressure which impinges on the pad 13, the slurry not only coats the upper surface of pad 13 but is also forced into the pores of the pad. Using such a spray technique the polishing action of the apparatus and method of the invention has been found to be comparable as for prior art devices but the improved apparatus and method uses less chemical slurry than a conventional CMP apparatus. The spray means 32 has a slot 36 for securing the spray distributor 32 to support 37. Openings in the spray distributor are preferably spaced uniformly over the pad surface.

As it is well known in the art, multiple wafers and/or multiple wafer carriers can be simultaneously processed on a single polishing turntable during a polishing operation. The spraying means is typically a closed elongated tube or rectangular distributor having a plurality of openings as shown in FIG. 2. Preferably, the openings have spray nozzles secured therein such as Arizona Mist P/N 80450-S. Any suitable nozzle means can be employed with a high dispersion nozzle being preferred. It is preferred that the openings and/or spray nozzles atomize the slurry forming a mist, e. g., fine slurry droplets. The spraying means is disposed over the polishing pad surface 13. The spraying means may also be configured and mechanically linked to the wafer carrier assembly 17 to move simultaneously together over the polishing pad while spraying the chemical slurry onto the pad surface. The slurry is sprayed downward, preferably substantially transverse to the polishing pad surface.

EXAMPLE

Figure 2:
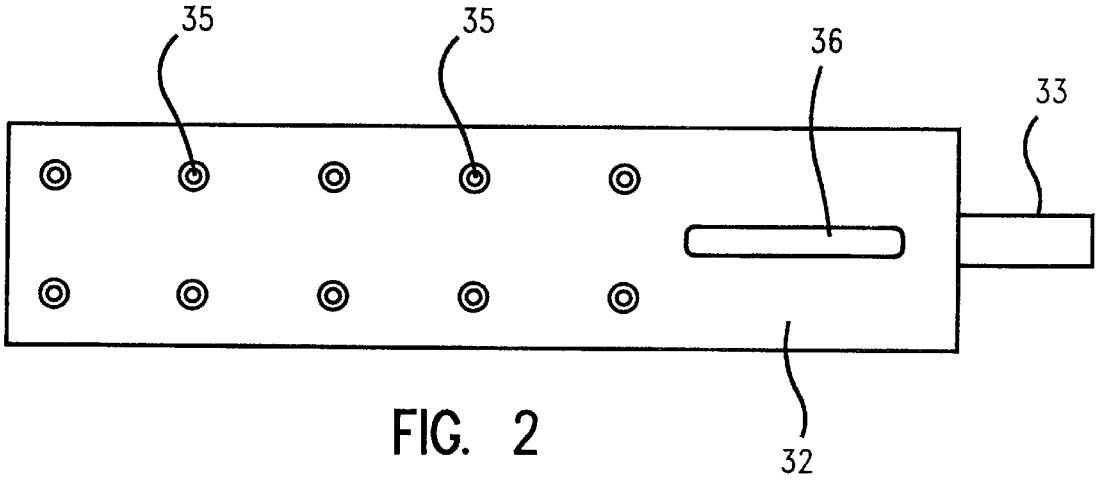
FIG. 2 is a top plan view of a spraying device of the invention.

Semiconductor wafers about 200 mm in diameter were processed under comparative conditions using an apparatus as shown in FIG. 1 except that, as indicated, a spray distributor as shown in FIG. 2 and a conventional process (no spray distributor—slurry dripped into the middle of the pad) were used. The results are as follows:

TABLE

| Run | Feed Slurry Conditions | Average Polishing Rate (Å/min) | Surface Uniformity |
|---|---|---|---|
| 1 | Spray Bar @ 120 mL/min | 2022 | 5.4% |
| 2 | Spray Bar @ 75 mL/min | 1922 | 5.2% |
| 3 | Spray Bar @ 50 mL/min | 1864 | 5.3% |
| A | Conventional @ 150 ml/min | 2075 | 6.5% |
| B | Conventional @ 150 mL/min with Spray Bar Rinse | 1977 | 7.5% |

As can be seen from the above data, Runs 1–3 of the invention show a slight decrease in polishing rate with a decreased slurry volume when spraying the slurry onto the pad surface with a spray distributor as shown in FIG. 2. The surface uniformity of the wafers were improved (i.e. decreased) when the spray bar was used compared with the prior art method, regardless of the volume of slurry used. The spray distributor thus allows the use of a smaller volume of slurry to achieve a comparable polishing rate and an improved surface uniformity. The slight decrease in polishing rate as slurry volume is reduced is not commercially significant.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An apparatus for polishing a surface of a workpiece comprising:

a rotatable turntable assembly;

a polishing pad supported on said assembly;

a rotatable carrier, located above said assembly and adapted to hold a workpiece during polishing, with said workpiece held on the lower surface of the carrier and positioned between said carrier and said polishing pad which when a force is applied to the upper surface of the rotatable carrier to contact the workpiece with the polishing pad the rotatable carrier provides a force across the workpiece surface such that the polishing process imparts a flat polished surface on the workpiece; and spraying means disposed over the surface of the polishing pad having a plurality of openings therein;

pressure means to feed a chemical polishing slurry into the spraying means forcing the slurry through the openings forming a spray which impinges on the polishing pad surface.

2. The apparatus of claim 1 wherein the workpiece is a semiconductor wafer.

3. The apparatus of claim 2 wherein the spraying means is positioned to spray the polishing slurry over about half the diameter of the surface of the polishing pad.

4. The apparatus of claim 3 wherein the spraying means comprises an elongated sealed container having a plurality of openings spaced in the container uniformly over the surface of the pad.

5. The apparatus of claim 4 wherein the openings contain spray nozzles therein.

6. The apparatus of claim 2 wherein the polishing pad is polyurethane.

7. The apparatus of claim 6 wherein the spraying means sprays the polishing slurry over about half of the diameter of the surface of the polishing pad.

8. The apparatus of claim 7 wherein the spraying means comprises an elongated sealed container having a plurality of openings spaced in the container uniformly over the surface of the pad.

9. The apparatus of claim 8 wherein the openings contain spray nozzles therein.

10. The apparatus of claim 9 wherein the pressure of the spray is about 20 to 50 psi.

11. A method of polishing a surface of a workpiece employing a polishing apparatus using a polishing pad which comprises spraying a polishing slurry onto the surface of the pad in the form of droplets or spray.

12. The method of claim 11 wherein said workpiece is mounted to the lower surface of a rotatable wafer carrier and the workpiece contacted with a rotating polishing pad to effect a polishing action across said workpiece, which method comprises the steps of mounting said workpiece to the lower surface of the carrier, applying a force to the upper surface of the carrier to contact the workpiece with the rotating polishing pad and spraying a polishing slurry from spraying means in the form of droplets or spray onto the surface of the polishing pad.

13. The method of claim 12 wherein the workpiece is a semiconductor wafer.

14. The method of claim 13 wherein the polishing slurry is sprayed over at about half of the diameter of the polishing pad.

15. The method of claim 14 wherein the spray from the spraying means is provided by spray nozzles.

16. The method of claim 15 wherein the polishing pad is polyurethane.

17. The method of claim 13 wherein the spraying means is a closed elongated distributor having a plurality of openings therein.

18. The method of claim 17 wherein spray nozzles are secured in the openings and are positioned in the distributor to provide a uniform spray over the surface of the pad.

19. The method of claim 18 wherein the polishing slurry is silica based.

20. The method of claim 19 wherein the pressure of the spray is about 20–50 psi.

21. The article of claim 20 wherein spray nozzles are employed in the openings in the spraying means.

22. The article of claim 21 wherein the spray nozzles are high dispersion spray nozzles.

23. The method of claim 11 wherein the polishing pad is polyurethane.

24. As an article of manufacture, a spraying means for spraying a polishing slurry onto a polishing pad wherein wafers or other electronic component substrates to be polished are held against a rotating polishing pad having the slurry thereon by a carrier which provides a force across the surface of the wafer aid imparts a flat polished surface on the wafer.

25. The article of claim 24 wherein the spraying means comprises a closed elongated tube having a plurality of openings for providing a spray of the polishing slurry.

* * * * *